US010295166B2

(12) United States Patent
Moon et al.

(10) Patent No.: US 10,295,166 B2
(45) Date of Patent: May 21, 2019

(54) DECORATIVE GLASS LIGHT AND ASSEMBLY METHOD THEREOF

(71) Applicant: Sang Pil Moon, Seoul (KR)

(72) Inventors: Dai Sung Moon, Seoul (KR); Sang Pil Moon, Seoul (KR)

(73) Assignee: Sang Pil Moon, Seoul (KR)

( * ) Notice: Subject to any disclaimer, the term of this patent is extended or adjusted under 35 U.S.C. 154(b) by 0 days.

(21) Appl. No.: 15/862,593

(22) Filed: Jan. 4, 2018

(65) Prior Publication Data

US 2018/0128473 A1 May 10, 2018

Related U.S. Application Data

(63) Continuation-in-part of application No. PCT/CN2016/073066, filed on Feb. 1, 2016.

(51) Int. Cl.

| | |
|---|---|
| ***F21V 3/00*** | (2015.01) |
| ***F21V 29/70*** | (2015.01) |
| ***F21S 2/00*** | (2016.01) |
| ***F21V 17/06*** | (2006.01) |
| ***F21K 9/232*** | (2016.01) |
| ***F21K 9/235*** | (2016.01) |
| ***F21V 17/12*** | (2006.01) |
| ***H01R 33/09*** | (2006.01) |
| ***F21V 23/00*** | (2015.01) |
| *F21V 29/506* | (2015.01) |
| *F21Y 115/10* | (2016.01) |
| *F21Y 105/18* | (2016.01) |

(52) U.S. Cl.

CPC ..... *F21V 29/70* (2015.01); *F21K 9/232* (2016.08); *F21K 9/235* (2016.08); *F21S 2/00* (2013.01); *F21V 17/06* (2013.01); *F21V 17/12* (2013.01); *F21V 23/006* (2013.01); *H01R 33/09* (2013.01); *F21V 29/506* (2015.01); *F21Y 2105/18* (2016.08); *F21Y 2115/10* (2016.08)

(58) Field of Classification Search

CPC ..... F21V 29/70; F21V 29/506; F21V 17/12; F21V 17/06; F21V 23/006; F21K 9/232; F21K 9/235; H01R 33/09; F21S 2/00; F21Y 2105/18; F21Y 2115/10

See application file for complete search history.

(56) References Cited

U.S. PATENT DOCUMENTS

2006/0091772 A1* 5/2006 Li ..... F21V 29/70 313/46
2013/0063957 A1* 3/2013 Sakai ..... F21V 3/00 362/363

FOREIGN PATENT DOCUMENTS

| | | |
|---|---|---|
| CN | 2748771 Y | 12/2005 |
| CN | 204100185 | 1/2015 |
| CN | 204268121 U | 4/2015 |

OTHER PUBLICATIONS

International Search Report of PCT Patent Application No. PCT/CN2016/073066 dated Oct. 31, 2016.

* cited by examiner

*Primary Examiner* — Ali Alavi

(57) ABSTRACT

The present invention relates to a decorative glass light having a light base, a light body and a light shade, wherein a heat-radiating tube and a PCB are sheathed in the light body, a LED board is placed at a top of the light body, one end of the PCB is connected to the LED board through wires, wires connected to the other end of the PCB pass through a PCB protection board.

9 Claims, 4 Drawing Sheets

DECORATIVE GLASS LIGHT AND ASSEMBLY METHOD THEREOF

CROSS-REFERENCE TO RELATED APPLICATIONS

The present application is a Continuation-in-part application of PCT application No. PCT/CN2016/073066 filed on Feb. 1, 2016, the contents of the above are hereby incorporated by reference.

FIELD OF THE INVENTION

The present invention relates to a pendant decorative light, especially to a decorative glass light and an assembly method thereof.

BACKGROUND OF THE INVENTION

Existing decorative glass lights are conventional incandescent light bulbs with a base having an outer ring to fix glass, disadvantage of which is the low luminous efficacy and a waste of electricity. Existing decorative glass lights may also be LED light bulbs having a LED driver and fixed on a conventional bulb base, disadvantage of which is the repetitive use of same structures, a waste of material and complicated assembly.

SUMMARY OF THE INVENTION

The present invention aims at providing a decorative glass light, a decorative glass light shade could be assembled externally. This structure is realized through arranging an exterior screw thread on an exterior surface of a light body, screwing an interior screw thread of a flange lock nut on the exterior screw thread of the light body and then fixing the decorative glass light shade with the flange lock nut. Such structure not only solves the disadvantage of low luminous efficacy and a waste of electricity that conventional incandescent light bulbs have, but also avoid the disadvantage of complicated structure and a waste of material that conventional LED lights have. The other aim of the present invention is at providing an assembly method of a decorative glass light which is not only convenient in assembling but also in using.

The decorative glass light comprises a light base, a light body and a light shade, wherein a heat-radiating tube and a PCB are sheathed in the light body, a LED board is placed at a top of the light body, one end of the PCB is connected to the LED board through wires, wires connected to the other end of the PCB pass through a PCB protection board.

Preferably, the light body consists of a tube-like body, an inner extension tube that forms an annular gap with the tube-like body when it being sheathed concentrically in the tube-like body, a cone piece that is concentrically projected from a top of the inner extension tube, a first wire hole opened at a top of the cone piece, and an opening provided on the opposite side of the inner extension tube to the cone piece.

Preferably, the heat-radiating tube consists of a cup-like body that is placed upside down and a second wire hole that is opened at a top of the cup-like body, the heat-radiating tube is sheathed in the annular gap formed within the light body.

Preferably, the decorative glass light further comprises a flange lock nut threadedly connected to the light body, an interior screw thread of the flange lock nut is screwed on an exterior screw thread of the light body.

Preferably, the light base consists of a first shallow bowl-like body, a nut that protrudes from a bottom of the first shallow bowl-like body, an annular groove that is formed between the first shallow bowl-like body and the nut, and connectors that symmetrically stand up from a brink of the first shallow bowl-like body.

Preferably, the PCB protection board is received in the light base. The PCB protection board consists of a tray-like body whose brink stands vertically and upwards, a third wire hole arranged at a center of the tray-like body, and clip pieces symmetrically arranged at the upward brink with each clip piece standing between two recesses. The wires connected to the other end of the PCB thread through said two recesses beside the clip piece, wind around the clip piece and then make their way through the third wire hole of the PCB protection board until reach outside of the decorative glass light.

Preferably, the light base consists of a second shallow bowl-like body and tapped holes that symmetrically stands on a junction portion of a side wall and a bottom of the second shallow bowl-like body.

An assembly method of decorative glass light comprising: sheathing a heat-radiating tube into an annular gap formed within a light body, placing a LED board on a top of the heat-radiating tube using a screw, sheathing a PCB into an inner extension tube from an opening of the light body; connecting the LED board and the PCB through wires, threading wires connected to the other end of the PCB through two recesses beside a clip piece of a PCB protection board, passing the wires connected to the other end of the PCB through a third wire hole of the PCB protection board until reach outside of the decorative glass light; mounting the light body on a light base, assembling a flange lock nut on an exterior surface of the light body to lock other components, soldering the wires that connect the LED board and the PCB to solder joints of the LED board; and clipping a light shade into the annular gap of the light body to complete the assembly.

Another assembly method of decorative glass light comprising: sheathing a heat-radiating tube into an annular gap formed within a light body, placing a LED board on a top of the heat-radiating tube using a screw, sheathing a PCB into an inner extension tube from an opening of the light body; connecting the LED board and the PCB through wires, riveting wires connected to the other end of the PCB with an electric conductive column riveted with a light base; mounting the light body on a light base by screwing a screw in a tapped hole of the light base and a screw hole set within the light body, assembling a flange lock nut on an exterior surface of the light body to lock other components, soldering the wires that connect the LED board and the PCB to solder joints of the LED board; and clipping a light shade into the annular gap of the light body to complete the assembly.

The beneficial effect brought by this invention is that the decorative glass light has high luminous efficacy and solves the disadvantage of low luminous efficacy and a waste of electricity that conventional incandescent light bulbs have. Additionally, the decorative glass light is of simple structure and easy assembly and saves material.

LIST OF REFERENCE NUMERALS

Figure 1:
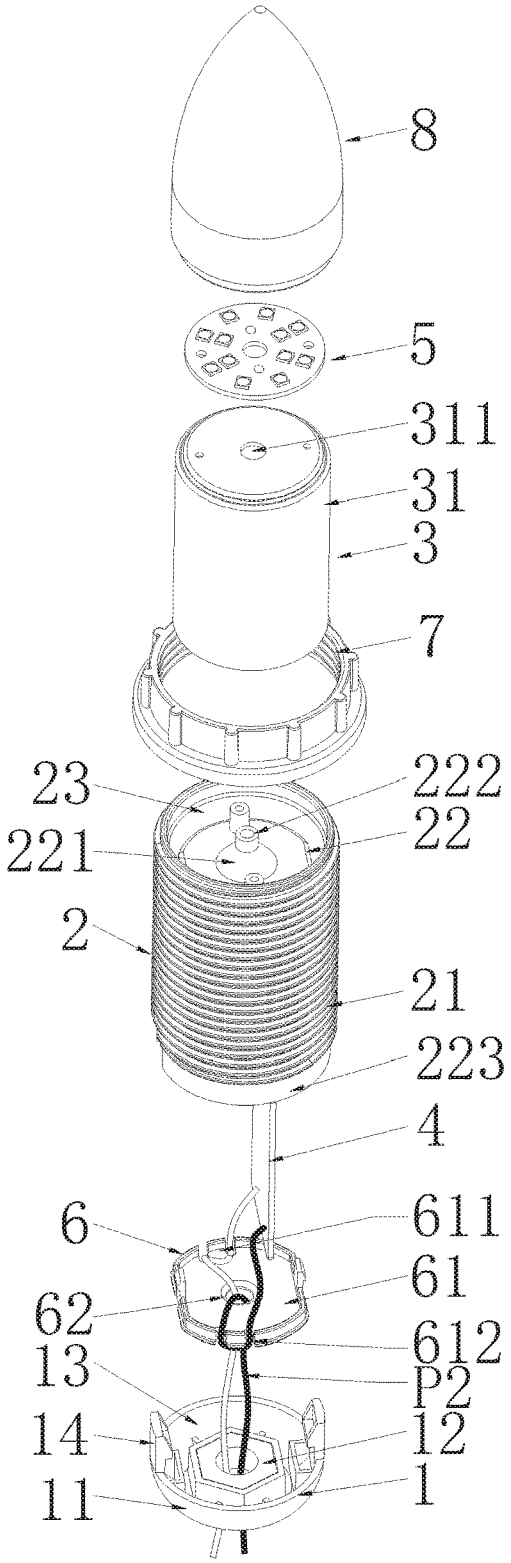
FIG. 1 is an exploded view of a decorative glass light according to a first embodiment of the present invention.

1. light base
11. first shallow bowl-like body/second shallow bowl-like body
12. nut
13. annular groove
14. connector
15. tapped hole
16. screw hole set within light body
2. light body
21. tube-like body
22. inner extension tube
221. cone piece
222. first wire hole
223. opening
23. annular gap
3. heat-radiating tube
31. cup-like body
311. second wire hole
4. PCB
5. LED board
6. PCB protection board
61. tray-like body
62. third wire hole
611. clip piece
612. recess
7. flange lock nut
8. light cover
9. screw
P1. wires
P2. wires

DETAILED DESCRIPTION OF ILLUSTRATED EMBODIMENTS

Embodiments of the present invention are further explained clearly as follows in conjunction with figures.

Figure 2:
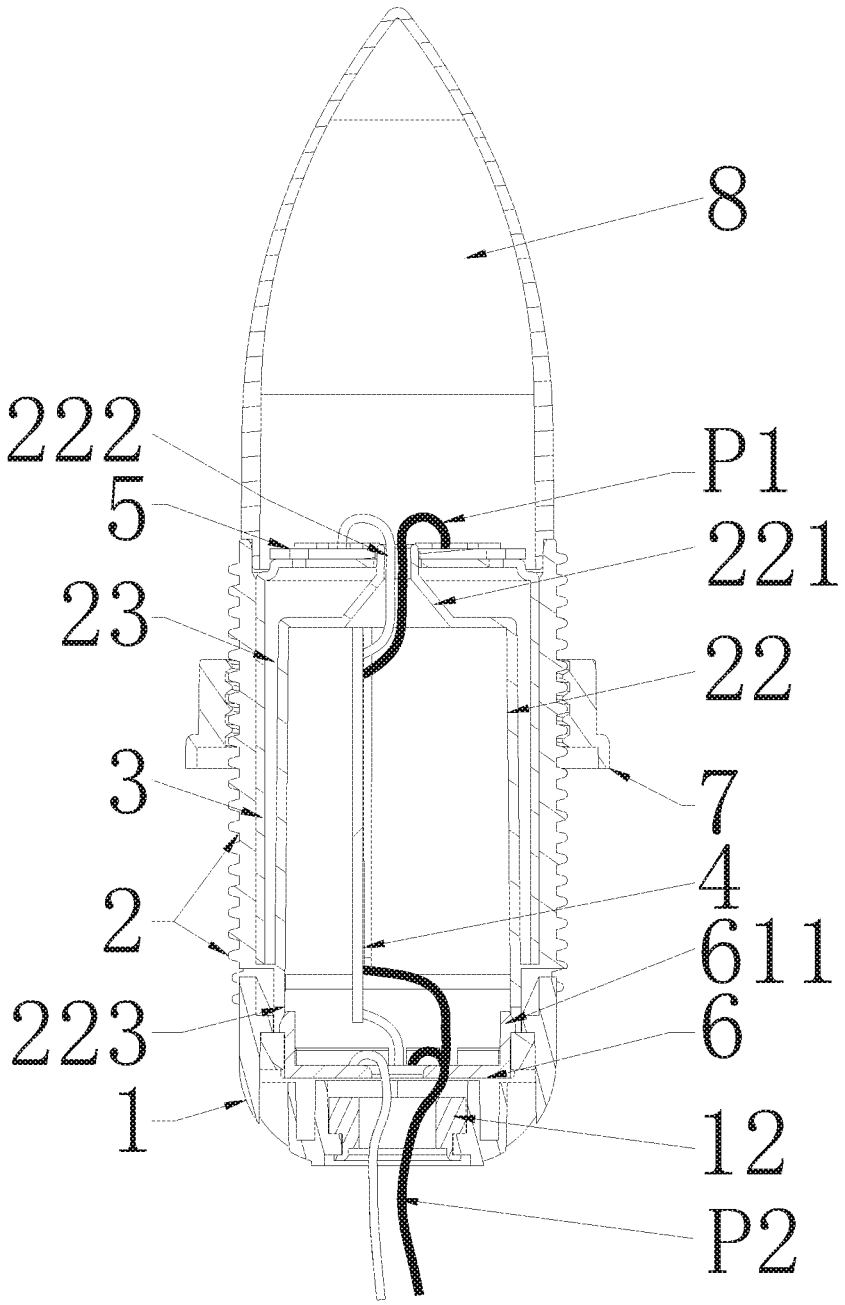
FIG. 2 is a cross-section view of an assembled decorative glass light according to FIG. 1 of the present invention.

As shown in FIGS. 1 and 2 of the first embodiment, a decorative glass light of the present invention comprises a light base 1, a light body 2, a flange lock nut 7 threadedly connected to the light body 2 and a light shade 8. A heat-radiating tube 3 and a PCB (printed circuit board) 4 are sheathed in the light body 2. A LED board 5 is placed at a top of the light body 2. One end of the PCB 4 is connected to the LED board 5 through wires P1. Wires P2 connected to the other end of the PCB 4 passes through a PCB protection board 6. An interior screw thread of the flange lock nut 7 is screwed on an exterior screw thread of the light body 2.

In the present embodiment, the light body 2 consists of a tube-like body 21, an inner extension tube 22 that forms an annular gap 23 with the tube-like body 21 when it being sheathed concentrically in the tube-like body 21, a cone piece 221 that is concentrically projected from a top of the inner extension tube 22, a first wire hole 222 opened at a top of the cone piece 221 and an opening 223 provided on the opposite side of the inner extension tube 22 to the cone piece 221.

In the present embodiment, the heat-radiating tube 3 consists of a cup-like body 31 that is placed upside down and a second wire hole 311 that is opened at a top of the cup-like body 31. The heat-radiating tube 3 is sheathed in the annular gap 23 formed within the light body 2.

In the present embodiment, the light base 1 consists of a first shallow bowl-like body 11, a nut 12 that protrudes from a bottom of the first shallow bowl-like body 11, an annular groove 13 that is formed between the first shallow bowl-like body 11 and the nut 12, and connectors 14 that symmetrically stand up from a brink of the first shallow bowl-like body 11.

In the present embodiment, the PCB protection board 6 is received in the light base 1. The PCB protection board 6 consists of a tray-like body 61 whose brink stands vertically and upwards, a third wire hole 62 arranged at a center of the tray-like body 61 and clip pieces 611 symmetrically arranged at the upward brink with each clip piece 611 standing between two recesses 612. The wires P2 connected to the other end of the PCB 4 thread through said two recesses 612 beside the clip piece 611, wind around the clip piece 611 and then make their way through the third wire hole 62 of the PCB protection board 6 until reach outside of the decorative glass light.

As shown in FIGS. 1 and 2, an assembly method of the decorative glass light is set out as follows:

sheathing the heat-radiating tube 3 into the annular gap 23 formed within the light body 2, placing the LED board 5 on the top of the heat-radiating tube 3 using a screw, and sheathing the PCB 4 into the inner extension tube 22 from the opening 223 of the light body 2;

connecting the LED board 5 and the PCB 4 through the wires P1, threading the wires P2 connected to the other end of the PCB 4 through the two recesses 612 beside the clip piece 611, passing the wires P2 through the third wire hole 62 of the PCB protection board 6 until reach outside of the decorative glass light;

mounting the light body 2 on the light base 1, assembling the flange lock nut 7 on an exterior surface of the light body 2 to lock other components; and soldering the wires P1 to solder joints of the LED board 5; and clipping the light shade 8 into the annular gap 23 of the light body 2 to complete the assembly.

Figure 3:
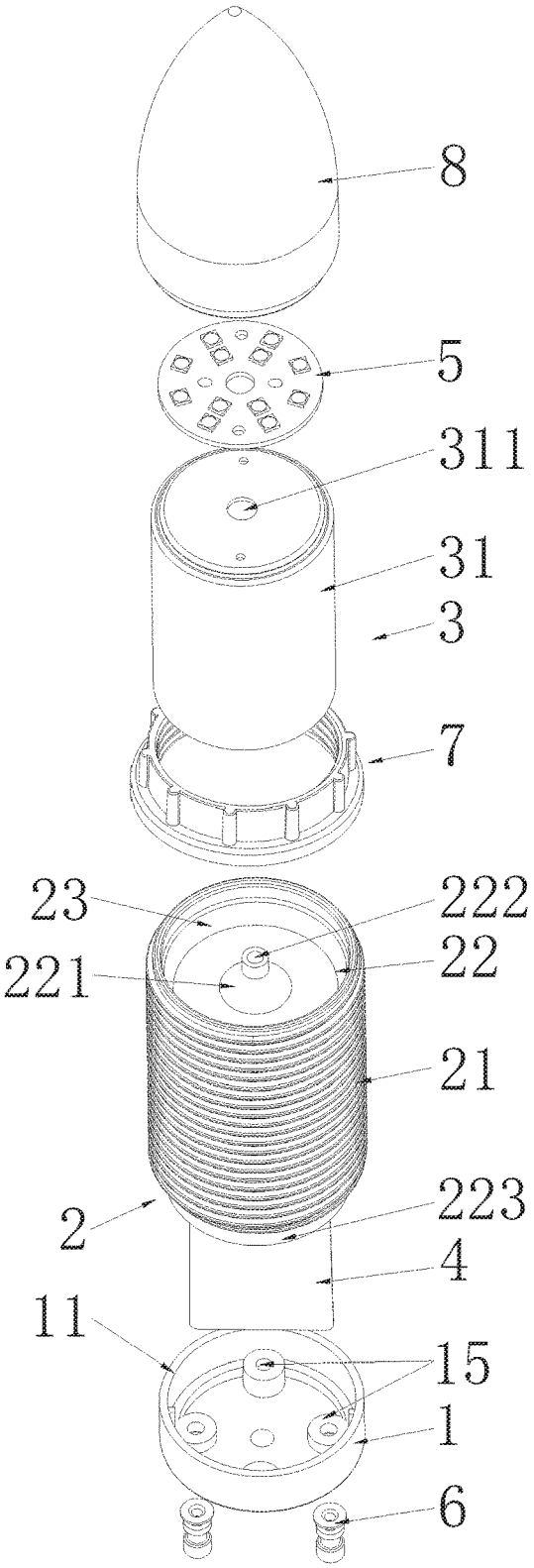
FIG. 3 is an exploded view of a decorative glass light according to a second embodiment of the present invention.
Figure 4:
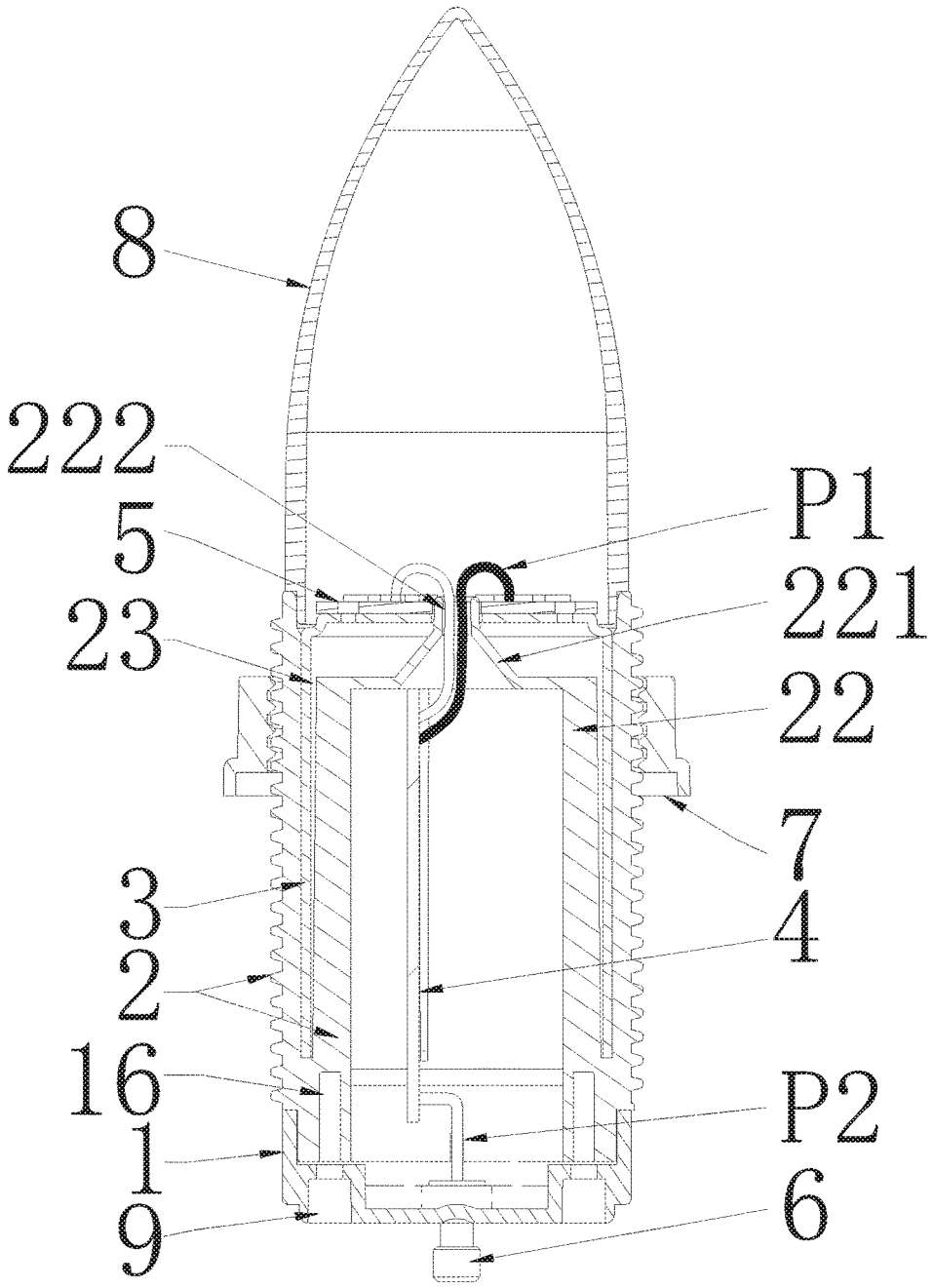
FIG. 4 is a cross-section view of an assembled decorative glass light according to FIG. 3 of the present invention.

FIGS. 3 and 4 set out the second embodiment of present invention.

As shown in FIGS. 3 and 4, the distinguishing feature of the second embodiment as compared with the first embodiment is the different structured light base. A light base 1 of the decorative glass light of the second embodiment consists of a second shallow bowl-like body 11 and tapped holes 15 that symmetrically stands on a junction portion of a side wall and a bottom of the second shallow bowl-like body 11.

Description of other same structures is omitted hereby.

As shown in FIGS. 3 and 4, the assembly method of the LED light bulb with soft light is set out as follows:

sheathing a heat-radiating tube 3 into an annular gap 23 formed within a light body 2, placing a LED board 5 on a top of the heat-radiating tube 3 using a screw, and sheathing a PCB 4 into an inner extension tube 22 from an opening 223 of the light body 2;

connecting the LED board 5 and the PCB 4 through wires P1, riveting wires P2 connected to the other end of the PCB 4 with an electric conductive column riveted with a light base 1;

mounting the light body 2 on the light base 1 by screwing a screw 9 in the tapped hole 15 of the light base 1 and a screw hole 16 set within the light body 2, assembling a flange lock nut 7 on an exterior surface of the light body 2 to lock other components, and soldering the wires P1 to solder joints of the LED board 5; and clipping a light shade 8 into the annular gap 23 of the light body 2 to complete the assembly.

The above-mentioned embodiments are the preferred embodiments of the present invention and are considered in all respects as illustrative and not restrictive. Variations and modifications are allowed within the scope of the invention. Those skilled in the art will appreciate that the features described above can be combined in various ways to form multiple variations of the invention. As a result, such variations fall within the scope of the protection to the present invention.

What is claimed is:

1. A decorative glass light, comprising a light base, a light body and a light shade; a heat-radiating tube and a PCB are sheathed in the light body, a LED board is placed at a top of the light body, one end of the PCB is connected to the LED board through wires, wires connected to the other end of the PCB pass through a PCB protection board;

wherein the light body consists of a tube-like body, an inner extension tube that forms an annular gap with the tube-like body when it being sheathed concentrically in the tube-like body, a cone piece that is concentrically projected from a top of the inner extension tube, a first wire hole opened at a top of the cone piece, and an opening provided on the opposite side of the inner extension tube to the cone piece.

2. The decorative glass light of claim 1, characterized in that the light base consists of a second shallow bowl-like body and tapped holes that symmetrically stands on a junction portion of a side wall and a bottom of the second shallow bowl-like body.

3. The decorative glass light of claim 1, characterized in that the heat-radiating tube consists of a cup-like body that is placed upside down and a second wire hole that is opened at a top of the cup-like body, the heat-radiating tube is sheathed in the annular gap formed within the light body.

4. The decorative glass light of claim 1, characterized in that the heat-radiating tube consists of a cup-like body that is placed upside down and a second wire hole that is opened at a top of the cup-like body, the heat-radiating tube is sheathed in the annular gap formed within the light body.

5. The decorative glass light of claim 1, characterized in that the decorative glass light further comprises a flange lock nut threadedly connected to the light body, an interior screw thread of the flange lock nut is screwed on an exterior screw thread of the light body.

6. The decorative glass light of claim 1, characterized in that the light base consists of a first shallow bowl-like body, a nut that protrudes from a bottom of the first shallow bowl-like body, an annular groove that is formed between the first shallow bowl-like body and the nut, and connectors that symmetrically stand up from a brink of the first shallow bowl-like body.

7. The decorative glass light of claim 1, characterized in that the PCB protection board is received in the light base; the PCB protection board consists of a tray-like body whose brink stands vertically and upwards, a third wire hole arranged at a center of the tray-like body, and clip pieces symmetrically arranged at the upward brink with each clip piece standing between two recesses; the wires connected to the other end of the PCB thread through said two recesses beside the clip piece, wind around the clip piece and then make their way through the third wire hole of the PCB protection board until reach outside of the decorative glass light.

8. An assembly method of decorative glass light comprising:

sheathing a heat-radiating tube into an annular gap formed within a light body, placing a LED board on a top of the heat-radiating tube using a screw, sheathing a PCB into an inner extension tube from an opening of the light body;

connecting the LED board and the PCB through wires, riveting wires connected to the other end of the PCB with an electric conductive column riveted with a light base;

mounting the light body on a light base by screwing a screw in a tapped hole of the light base and a screw hole set within the light body, assembling a flange lock nut on an exterior surface of the light body to lock other components, soldering the wires that connect the LED board and the PCB to solder joints of the LED board; and clipping a light shade into the annular gap of the light body to complete the assembly.

9. An assembly method of decorative glass light comprising:

sheathing a heat-radiating tube into an annular gap formed within a light body, placing a LED board on a top of the heat-radiating tube using a screw, sheathing a PCB into an inner extension tube from an opening of the light body;

connecting the LED board and the PCB through wires, threading wires connected to the other end of the PCB through two recesses beside a clip piece of a PCB protection board, passing the wires connected to the other end of the PCB through a third wire hole of the PCB protection board until reach outside of the decorative glass light;

mounting the light body on a light base, assembling a flange lock nut on an exterior surface of the light body to lock other components, soldering the wires that connect the LED board and the PCB to solder joints of the LED board; and clipping a light shade into the annular gap of the light body to complete the assembly.

* * * * *